United States Patent [19]

Kessler

[11] 4,235,390

[45] Nov. 25, 1980

[54] FABRIC REEL FOR PLUSH FABRICS

[75] Inventor: Theodore P. Kessler, Rancocas, N.J.

[73] Assignee: Timron, Inc., Moorestown, N.J.

[21] Appl. No.: 933,824

[22] Filed: Aug. 15, 1978

[51] Int. Cl.[3] ..... B65H 75/02

[52] U.S. Cl. ..... 242/77.1; 206/389; 206/398; 242/62

[58] Field of Search ..... 242/77.1, 62; 206/389, 206/397, 398, 400, 407, 408

[56] References Cited

U.S. PATENT DOCUMENTS

| | | | |
|---|---|---|---|
| 2,922,516 | 1/1960 | Kessler | 242/77.1 X |
| 3,231,080 | 1/1966 | Williams | 242/77.1 X |
| 3,944,157 | 3/1976 | Kessler | 242/77.1 |

*Primary Examiner*—Stanley N. Gilreath
*Attorney, Agent, or Firm*—Kenyon & Kenyon

[57] ABSTRACT

The reel is constructed with a pair of end frames, each of which has an end board provided with elongated apertures in the end board. The apertures permit viewing of the contents of the reel when the reel is mounted in a horizontal storage position. The apertures also provide a manual means for grasping of the reel in order to remove the reel from a shipping carton. The hook-containing strips of each end frame terminate short of the corners of the cardboard to mount the reel contents in a slightly suspended condition in a shipping carton.

1 Claim, 5 Drawing Figures

Fig. 1.
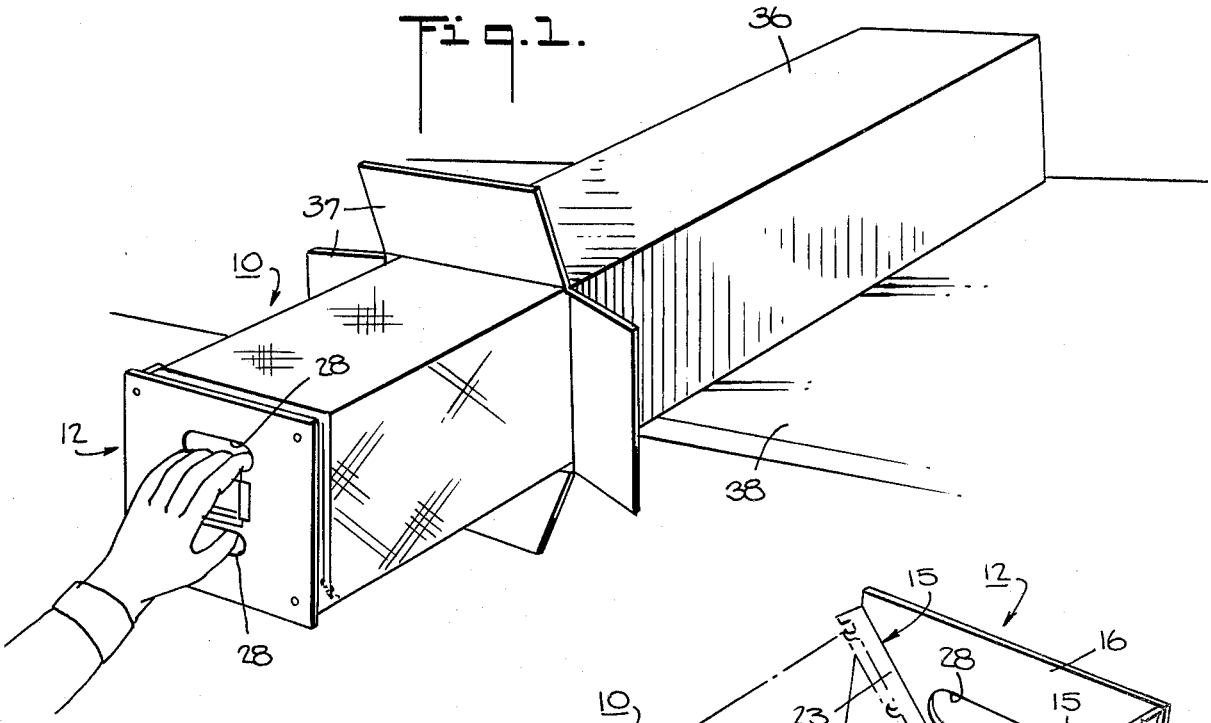
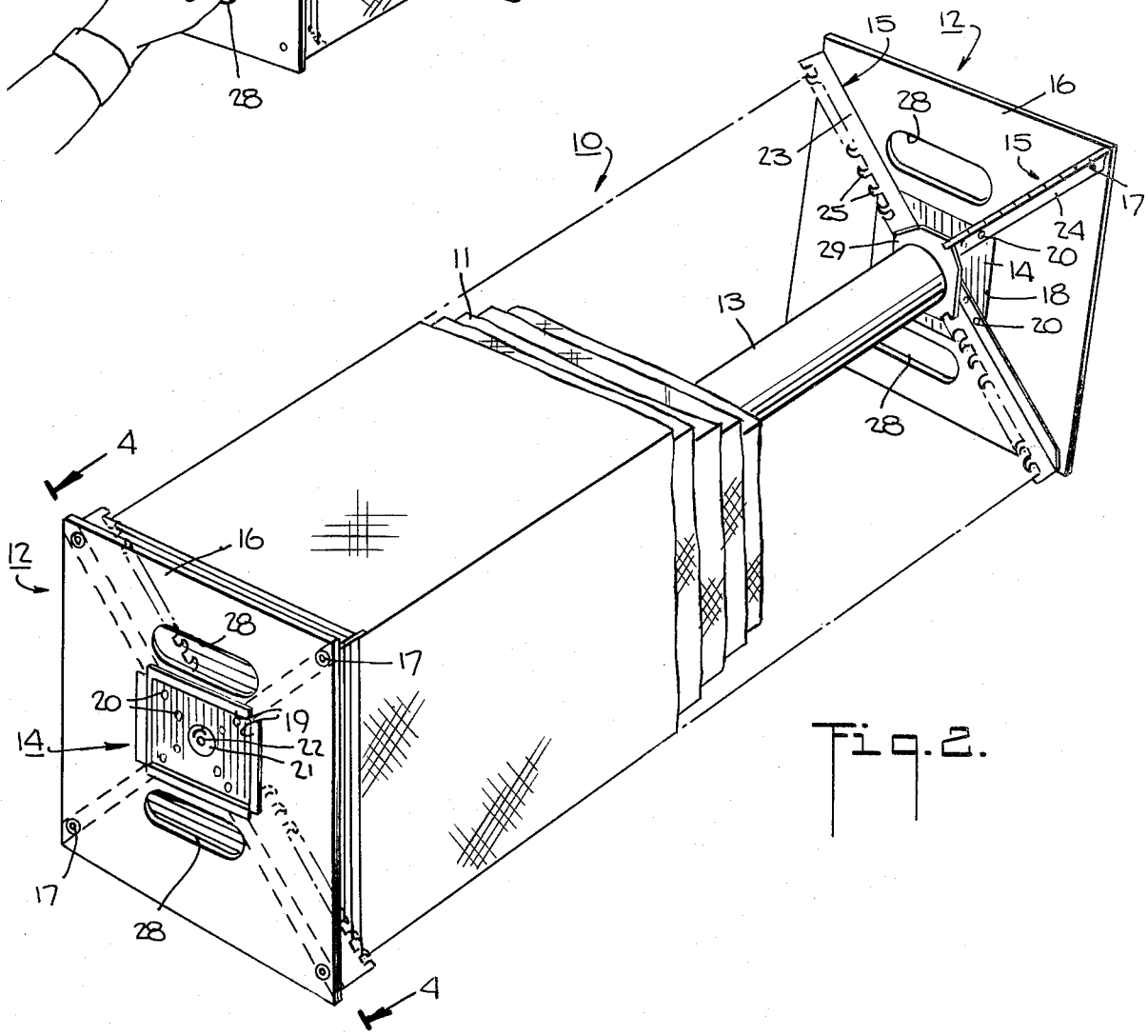
Fig. 2.

FABRIC REEL FOR PLUSH FABRICS

This invention relates to a reel for plush fabrics. More particularly, this invention relates to an end frame for a fabric reel.

As is known, various types of end frames and reels have been utilized for shipping fabrics, such as pile and plush fabrics. In some cases, the end frames have been constructed of hook strips which radiate from a central plate in order to form a rigid unit. Generally, two such end frames are held apart by a spacer in order to form a reel upon which fabric can be reeled. After winding, the filled reels can be packaged in various types of cardboard shipping containers. In other cases, the end frames have been constructed with end boards which can form the ends of shipping cartons. In these cases, the end frames are generally constructed such that the hook-containing strips are attached to a cardboard end board while a metal end plate is secured centrally to the hook-containing strips and the board. Examples of such constructions are described in U.S. Pat. Nos. 3,944,157 and 4,057,143.

In some cases, pile fabrics, such as plush materials which are shipped to a millinery house on these reels, only require removal of a portion of the wound material at a given time. In such cases, the reels are stored, for example horizontally on shelves, and are removed from time to time in order to obtain a length of fabric. Thus, when a multiplicity of reels of fabrics of different colors and types are stored, it becomes necessary to store the reels in predetermined locations so that the correct color or type of material can be quickly located and obtained. However, because the reels are usually stored horizontally rather than in an upright vertical position, it becomes difficult to view the contents of the reels, particularly if the end frames include end boards in their assembly. In such cases, an incorrect reel may be pulled from storage before the correct reel is located and obtained.

Further, if the reels are constructed without end boards, the skeletal end frames do not provide sufficient protection for the contents of the reel against soilage from the environment in which the reels are stored. Also, in these cases, difficulties may arise in any attempt to remove a reel from storage and to thereafter return the reel to storage. For example, if the wound fabric of adjacent reels are unraveled, the resultant loose ends may interfere with the movements of the reel to be removed or replaced. Also, if a reel is to be removed manually, there is a risk of personal injury should the hook-containing strips be grasped.

Accordingly, it is an object of the invention to provide a reel for plush materials wherein the contents of the reel can be readily viewed.

It is another object of the invention to provide a simple means of storing plush fabric on shelves.

It is another object of the invention to provide a relatively simple end frame for a reel to permit removal of the reel from a carton.

It is another object of the invention to provide a relatively simple means of sorting plush materials on shelves.

Briefly, the invention provides a reel for pile fabric which is comprised of a pair of end frames and a spacer bar between the end frames. Each end frame is constructed of a plate, a plurality of hook-containing sections for impaling a fabric material thereon, a flat board and a means securing each hook-containing section to the board. In order to permit viewing of the contents of a reel, the flat board of the end frame is provided with at least one elongated aperture which is disposed at the end frame between a respective pair of hook-containing sections.

In addition, the end frames are constructed to permit the reel to be slidably received within a shipping carton having an elongated longitudinal axis and a plurality of flaps at each end for closing over the reel. To this end, the hook-containing sections extend outwardly from the plate in a radiating pattern and terminate at a short distance from the corners of the flat board which is made of polygonal shape with a plurality of straight edges defining a plurality of corners. Because the hook-containing strips terminate short of the corners of the flat board, the reel can be slid relatively easily into and out of a shipping carton without the hook-containing strips being impaled in the walls of the shipping carton. In a sense, the hook-containing strips are disposed in a floating condition within the shipping carton not only during shipping but also during storage. As a result, the danger of damage to the end frames during shipping can be reduced. That is, should a shipping carton be dropped on an end, the corners of the end boards may be deformed so as to absorb the shock rather than the hook-containing strips.

In addition to the above, the shipping carton can be used for storage purposes. Thus, when received by a consumer, the shipping carton can be placed on a shelf in a horizontal position. In this position, the end flaps of the carton can be removed or can remain. Subsequently, should it be necessary to remove a reel or to determine the color, type or amount of material on the reel, inspection can be made via the apertures in the end board of an exposed end frame. If the flaps of the shipping carton are retained, these flaps must, of course, be opened. However, the flaps of the carton would usually be removed to expose an end frame of the reel.

In the event that a reel is to be removed from storage, the exposed end frame can be manually grasped via the apertures and slid out of the shipping carton. After a certain length of material has been removed from the reel, the partially wound reel can be slid back into the shipping carton for storage purposes.

These and other objects and advantages of the invention will become more apparent from the following detailed description taken in conjunction with the accompanying drawings wherein:

FIG. 1 illustrates a perspective view of a reel according to the invention in a position partially removed from a shipping carton;

FIG. 2 illustrates a perspective view of a reel according to the invention wound with pile fabric;

Figure 3:
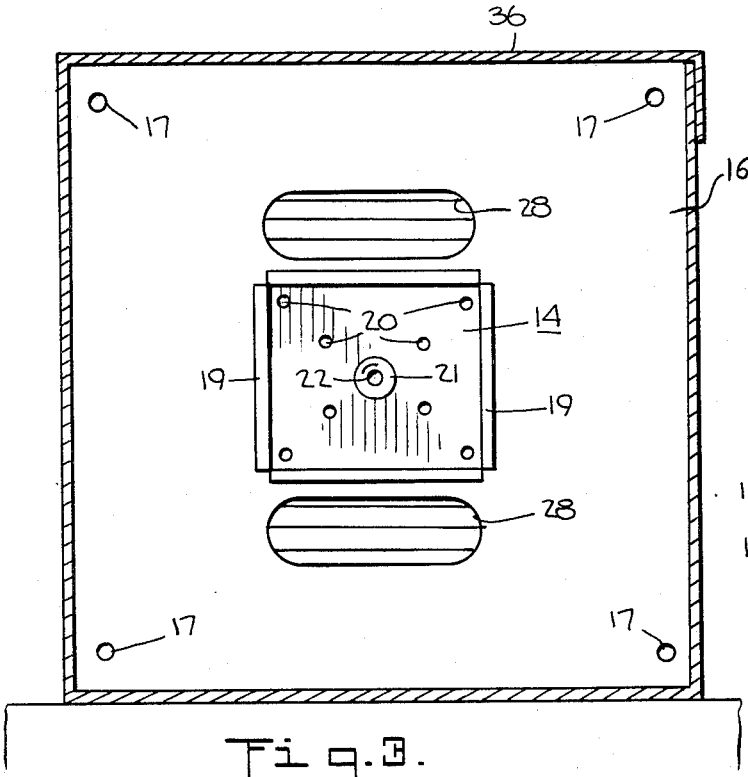
FIG. 3 illustrates an end view of a reel and shipping carton in a storage position in accordance with the invention.

Referring to FIG. 2, the reel 10 on which a pile fabric 11 such as a plush material is wound is constructed of a pair of end frames 12 and a spacer bar 13 which holds the end frames 12 in spaced apart manner. Each end frame 12 is comprised of a plate 14, for example, of metal, a plurality of hook-containing strips or sections 15 for impaling of the fabric material 11, a flat board 16 and means 17, such as rivets, securing the hook containing section 15 to the board 16.

Figure 4:
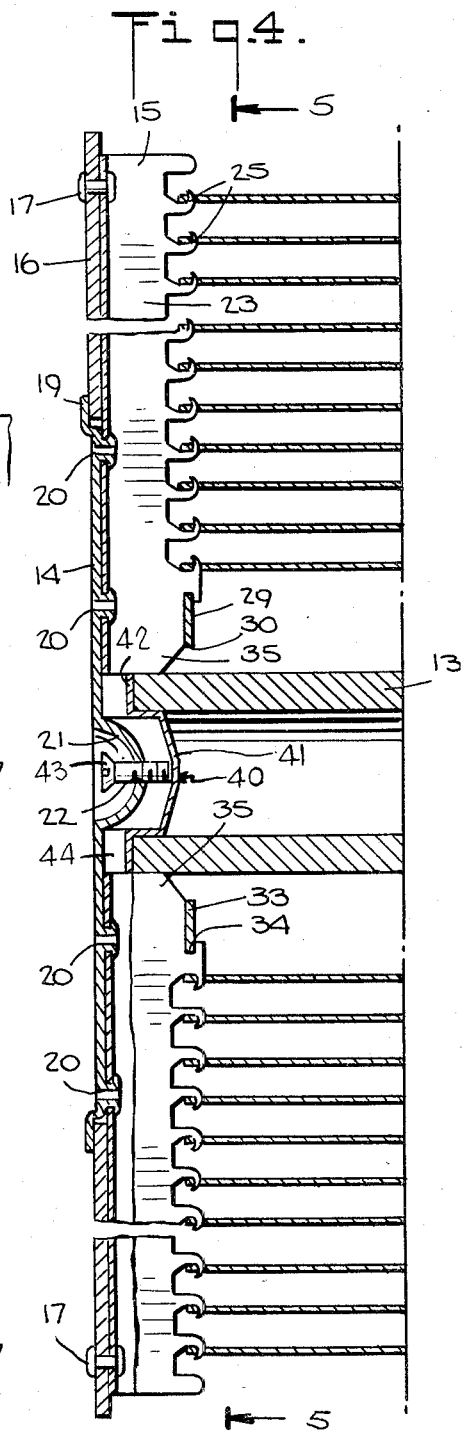
FIG. 4 illustrates a view taken on line 4—4 of FIG. 2.

Referring to FIGS. 2 and 4 each plate 14 is of a polygonal shape, e.g. rectangular, and has a recessed cross sectional shape so as to be received within an aperture 18 of the board 16. The plate 14 also has a plurality of lips 19 which overlie the board 16 on a side opposite the hook containing sections 15. As shown in FIG. 4, the plate 14 is secured directly to the sections 15 via suitable fastening means 20 such as rivet-like means as described in U.S. Patent Applicaton Ser. No. 874,107, filed Feb. 1, 1978.

Each plate 14 is also provided with a centrally located dome shaped protrusion 21 which has a central hole 22 for mounting of the end frame 10 on a fabric winder as is known. The plate 14 also presents a flat surface toward the hook containing sections 15 about the protrusion 21.

Referring to FIGS. 2 and 4, the hook-containing sections 15 are of generally known construction and extend outwardly from the plate 14 in a radiating pattern. As shown in FIG. 4, each section 15 is of L-shaped cross section with a leg 23 extending perpendicularly of the board 16 and a base leg 24 parallel and adjacent to the board 16. The outstanding leg 23 carries a plurality of hooks 25 for impaling the edges of the material 11 while the base leg 24 extends towards a corner 26 of the board 16 and terminates at a short distance, for example ⅛ inch, from the corner 26. The outer end of the base leg 24 is also provided with a chamfered edge 27 parallel to a side of the board 16. The sections 15 are disposed in an alternating manner about the plate 14 so that the base legs 24 of the two adjacent sections 15 face each other while the base legs 24 of the next two sections 15 face away from each other (see FIG. 5). Also, the legs 23 radiate from the center of the plate 14.

Figure 5:
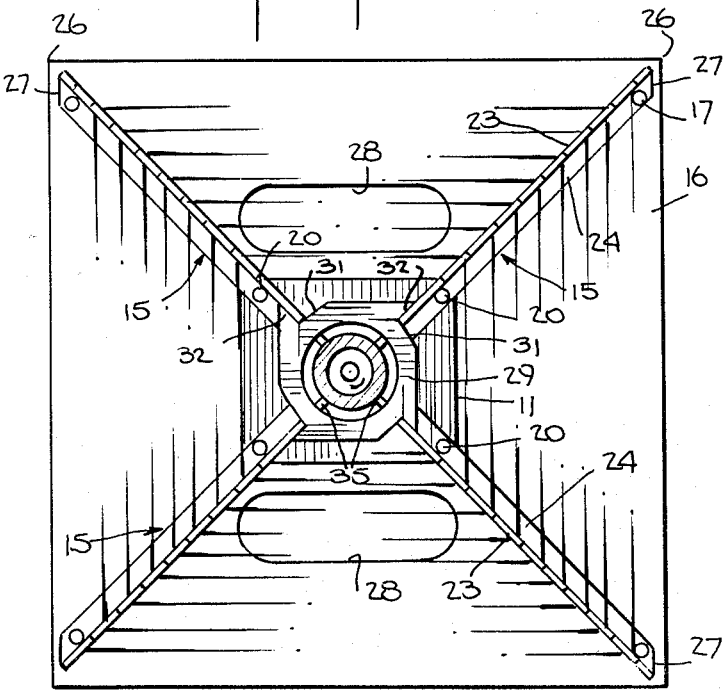
FIG. 5 illustrates a view taken on line 5—5 of FIG. 4.

Referring to FIG. 2, each board 16 is made of cardboard and is of a polygonal shape, i.e. rectangular, with a plurality of straight edges defining the corners 26. Each board 16 also has a pair of elongated apertures 28 which are disposed on opposite sides of the plate 14. As shown in FIG. 5, each aperture 28 is positioned between a pair of sections 15 wherein the base legs 24 face away from each other. The board 16 is of a thickness equal to the profiled thickness of the plate 14 so as to present a smooth inside surface and a smooth surface outside the lips 19 of the plate 14.

Referring to FIGS. 2 and 5, each end frame also has a flat lock plate 29 which is mounted centrally of the hook containing sections 15 in locking relation with these sections 15. To this end, each lock plate 29 is of generally polygonal shape corresponding to the number of sections 15, for example rectangular, and is provided with a central aperture 30. In addition, each corner of the plate 29 is provided with a chamfered surface 31 (FIG. 5) and a tongue 32. The chamfered surfaces 31 are sized to permit the lock plate 29 to be received within a recessed portion 33 of each section 15 and turned into an undercut slot 34 in each hook containing section 15. The tongues 32 are adapted to abut against the hook containing sections 15 in order to limit turning of the lock plate 29 on the sections 15. Such a construction is generallly known and need not be further described.

As shown in FIG. 5, the aperture 30 of the lock plate 29 is sized so that the inner ends of the legs 23 of the sections 15 extend into the plane of the aperture 30. Further, each section 15 is provided with a chamfered corner 35 adjacent to the lock plate 29.

As shown in FIG. 4, the spacer tube 13 is sized to pass through each lock plate 29 and be received with a sliding fit between the ends of the sections 15 while being spaced about the protuberances 21. This provides a tight fit for the spacer tube 13 in each end frame 12.

Referring to FIG. 1, the reel 10 is sized to be slidably mounted within a shipping carton 36. As shown, the shipping carton 36 has an elongated longitudinal axis and a plurality of flaps 37 at each end (only one end is shown) for closing over the reel 10.

After a reel has been wound with material 11 and has been placed in a shipping carton 36, the packagaged reel can be shipped to a consumer. The consumer can then place the shipping carton e.g. horizontally on a shelf 38 and, after opening the flaps 37, can remove the reel 10 manually from the carton 36. As shown in FIG. 1, this can be accomplished by manually grasping the exposed end frame 12 via the apertures 28 and sliding the reel 10 from the carton 36.

Referring to FIG. 3, for purposes of storage, the flaps 37 of the shipping carton 36 can be removed so that one end of the reel 10 can be exposed to view. In this condition, the contents of the reel 10 can be viewed via the apertures 28. Thus, should one wish to determine the color of the fabric 11, inspection can be readily made via the apertures 28. Such an inspection can also indicate the amount of material which remains within the reel 10.

Since the hook containing sections 15 are spaced from the corners 26 of the end boards 16, the reel is generally supported via the end board 16 within the shipping carton 36 in a floating condition. Thus, when the reel 10 is slid out of the carton 36, the weight of the reel 10 is supported by the two boards 16. Also, sliding of the material 11 and section 15 on the side walls of the shipping carton 36 can be held to a minimum.

Referring to FIG. 4, a spacer cap 40 which is shaped as a derby hat is mounted on each end of the spacer bar 13 in recessed manner. Each cap 40 has a cup-like portion 41 within the spacer bar 13 and a peripheral flange 42 which abuts the end of the spacer bar 13. After fabric 11 has been wound on the reel 10, a screw 43 or the like is threaded into the hole 22 in one or both plates 14 and abutted against the cap 40. Further threading in of the screw 43 forces the end frame 12 away from the spacer bar 13 to create a gap 44. Thus, any minute sag in the fabric 11 can be taken out.

The invention thus provides a reel for pile fabric which is of relatively simple construction and which permits viewing of the contents of the reel.

Further, the invention provides a reel which can be stored in its shipping carton in a horizontal position.

What is claimed is:

1. A reel for pile fabric comprising a pair of end frames, each said end frame including a plate having a centrally located hole; a plurality of hook-containing sections for impaling a fabric material thereon secured to said plate, said sections extending outwardly from said plate in a radiating pattern; a flat board disposed about said plate and having a central aperture receiving said plate therein; and a lock plate mounted centrally of said sections in locking relation with said sections and having a central aperture therein;

a hollow spacer bar between said end frames, said bar being received at each end within said central aperture of each respective lock plate and in engagement with said sections;

a spacer cap mounted on at least one end of said spacer bar; and a screw threaded into said hole of said plate of the end frame facing said one end of said spacer bar, said screw being disposed in abutment with said cap to move said end frame away from said spacer upon threading of said screw into said end frame.

* * * * *